US008393895B2

(12) United States Patent
Schwartz et al.

(10) Patent No.: US 8,393,895 B2
(45) Date of Patent: Mar. 12, 2013

(54) TRANSVERSE OVEN AND METHOD OF BAKING WORKPIECES

(75) Inventors: Glen N. Schwartz, Warren, MI (US); Joseph E Claya, Ortonville, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 1236 days.

(21) Appl. No.: 12/193,013

(22) Filed: Aug. 17, 2008

(65) Prior Publication Data

US 2010/0038353 A1 Feb. 18, 2010

(51) Int. Cl.
*F27B 5/14* (2006.01)

(52) U.S. Cl. ..... 432/124; 432/202; 34/270

(58) Field of Classification Search ..... 122/62, 122/64, 122, 124, 147, 175, 202, 209; 34/266, 34/270, 272

See application file for complete search history.

(56) References Cited

U.S. PATENT DOCUMENTS

| | | | | |
|---|---|---|---|---|
| 4,585,411 | A | 4/1986 | Bocci et al. | |
| 4,785,552 | A | 11/1988 | Best | |
| 5,230,161 | A | 7/1993 | Best | |
| 5,568,692 | A | 10/1996 | Crompton et al. | |
| 5,594,999 | A | 1/1997 | Best | |
| 5,661,912 | A * | 9/1997 | Bhatnagar et al. | 34/270 |
| 5,743,962 | A * | 4/1998 | Ogasawara et al. | 118/643 |
| 6,062,850 | A * | 5/2000 | Ino et al. | 432/143 |
| 6,769,909 | B2 | 8/2004 | Schwartz | |
| 7,063,528 | B2 * | 6/2006 | Klobucar et al. | 432/147 |
| 7,264,467 | B1 * | 9/2007 | Mitchell et al. | 432/147 |

FOREIGN PATENT DOCUMENTS

| | | |
|---|---|---|
| DE | M9066 | 4/1951 |
| DE | 4127580 C1 | 2/1993 |
| DE | 102005011890 A1 | 11/2005 |
| DE | 60106376 T2 | 2/2006 |
| DE | 102005034930 A1 | 3/2006 |

* cited by examiner

*Primary Examiner* — Gregory A Wilson

(57) ABSTRACT

A manufacturing oven for and a method of baking a workpiece presenting a transverse orientation relative to the oven, includes dual radiant and convection heating sources operable to uniformly heat the workpiece by focusing convection heating air towards desirous parts of the workpiece, and preferably includes a chamber, a high emissivity false floor, at least one radiant heating element beneath the floor, at least one reflector beneath each element and configured to redirect radiant heat energy towards the floor, a fresh air heater for delivering fresh heated air into the chamber, an exhaust system for removing heated air and evaporated paint solvents from the chamber, and at least one ceiling fan operable to cause lighter heated air to flow from the ceiling of the chamber and towards the workpiece.

22 Claims, 5 Drawing Sheets

TRANSVERSE OVEN AND METHOD OF BAKING WORKPIECES

BACKGROUND

The present invention relates to manufacturing ovens and methods of baking workpieces, and more particularly, to an oven presenting, and a method of baking workpieces utilizing, dimensions suitable for transverse baking, and/or a more uniform heating configuration having dual heat sources.

BACKGROUND OF THE INVENTION

Manufacturing ovens are used to bake workpieces to specified temperature ranges as part of many curing processes. In automotive settings, for example, recently painted workpieces have long been conveyed longitudinally into an elongated oven that typically features radiant heat sources located along the outside perimeter of a chamber. Though widely utilized, various concerns are appreciated in the art. For example, the longitudinal orientation of conventional ovens works well for heating most vehicle body types but does not make efficient use of floor space. Where space is limited, some conventional ovens present a "U"-shaped layout that requires large spaces between workpieces, so as to provide necessary clearance when a longitudinal workpiece is processed through the turn of the oven.

Of further concern is often the method of heating. For example, it is appreciated by those of ordinary skill in the art that radiant heat transfers heat at high rates but only to the areas of the workpiece exposed through a direct line of sight. Convection heat is able to treat indirectly, but requires high volumes of air for good heat transfer rates. Irrespective of the mode of heating, however, another concern is the radial positioning of heat sources, which often results in inadequate heating of the workpieces near the lateral centerline of the oven. Moreover, conventional one-size fits all configurations do not enable the flexibility needed to focus heat where most needed. For example, with respect to vehicles, an area of particular concern is the lower heavy metal area between the wheel openings, known as the "rocker." It is appreciated that this area requires greater heat saturation due to increased material thickness.

SUMMARY OF THE INVENTION

In the present invention, a more compact manufacturing oven layout is provided that facilitates transverse baking and addresses the afore-mentioned concerns. More particularly, in a preferred embodiment, the dimensions of the oven are such that the longitudinal axis of the workpiece is able to define an angle up to ninety degrees with the longitudinal axis of the oven (during baking), without substantially increasing the overall width of the oven. This layout may reduce operating costs, and required floor space and/or capital costs.

The inventive oven utilizes a combination of radiant and convection heating to treat the workpieces more effectively. Sufficient heating along the lateral centerline of the oven is provided, in one embodiment, by providing radiant heat from a high emissivity false floor, heated fresh air supplied through openings defined by the floor or by duct above the floor, and at least one ceiling fan for continued convection heating. Thus, among other things, the invention is useful for providing more uniform heating and treatment of troublesome areas, than do conventional ovens.

Thus, a first aspect of the invention concerns a transverse oven adapted for baking a workpiece, wherein the workpiece presents a first longitudinal axis, length and width. The oven includes an enclosable chamber defining an interior space, entrance and outlet openings, and a second longitudinal axis. The chamber, entrance and outlet are cooperatively configured such that the workpiece is able to enter, pass through, and exit the space, when the first and second axes define an angle greater than zero and up to ninety degrees. Finally, a plurality of radiant and convection heat sources are thermally coupled to the space and cooperatively configured to heat the entire workpiece to a target temperature range, when the workpiece is in the space.

A second aspect of the invention concerns a method of baking a workpiece defining a first longitudinal axis, in an oven defining a second longitudinal axis. The method preferably includes the initial step of rotating the workpiece to a transverse orientation, wherein the first and second longitudinal axes form a minimum angle, and entering the workpiece into the oven in the transverse orientation. Next, the workpiece is treated with convection and radiant heating during Bring-up, Equalize, and Hold periods, so as to cause the workpiece to reach a target temperature range. The workpiece exits from the oven in the transverse orientation, after the periods, and rotates back to the longitudinal orientation to continue the work-in-progress.

It will be appreciated and understood that the oven and methods of baking offered by the present invention provide a number of improvements and advantages over the prior art. The aforementioned aspects, features, and/or species of the present invention are discussed in greater detail in the section below titled DESCRIPTION OF THE PREFERRED EMBODIMENT(S).

BRIEF DESCRIPTION OF THE DRAWINGS

Preferred embodiments of the invention are described in detail below with reference to the attached drawing figures, wherein.

DESCRIPTION OF THE PREFERRED EMBODIMENT(S)

Figure 1:
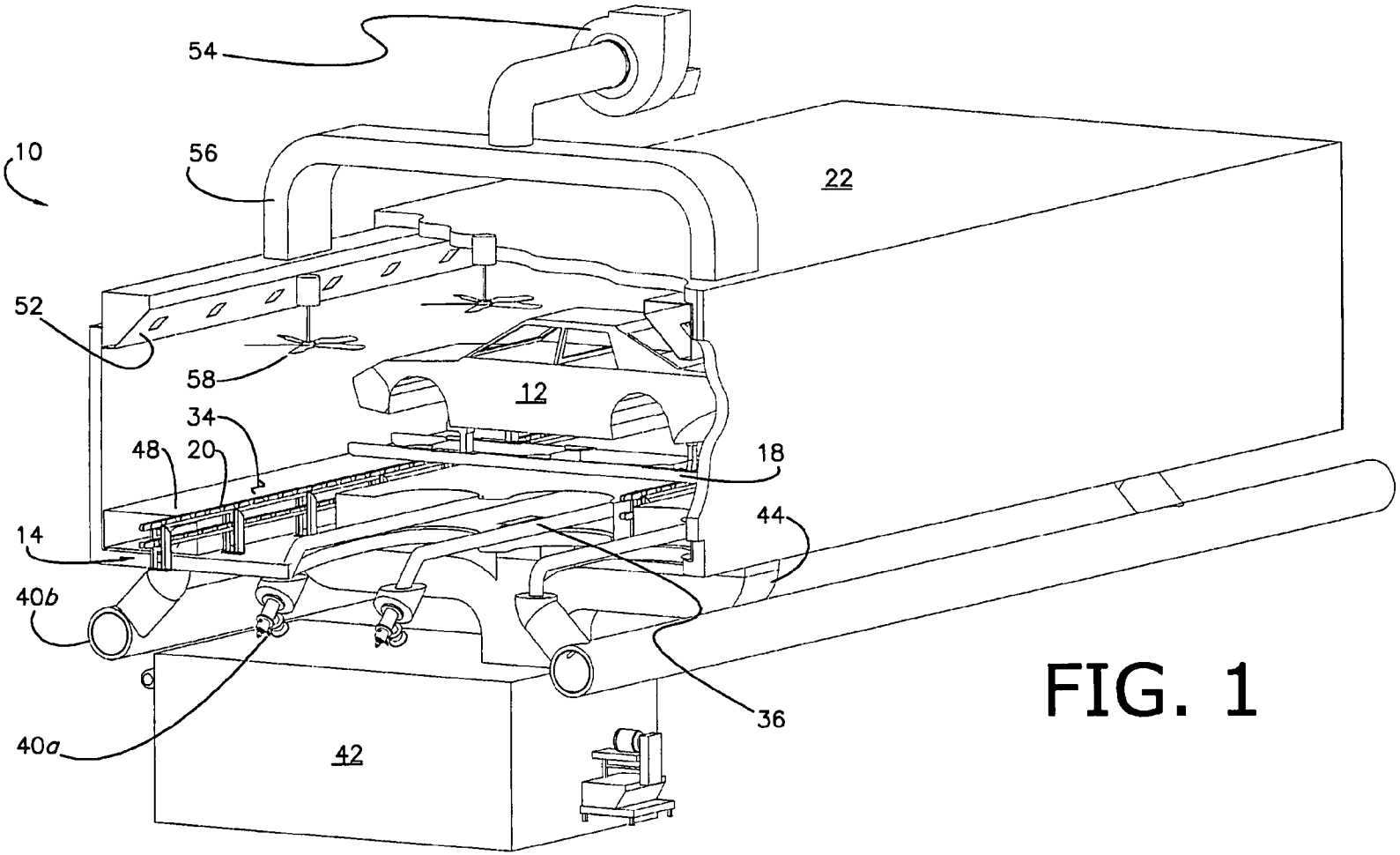
FIG. 1 is a perspective view of a conveyed vehicle body workpiece being baked inside of a transverse oven including a housing chamber, a high emissivity false floor within the chamber, radiant heating tubes having a generated flame therein and low emissivity reflectors located beneath the floor, ceiling fans, and an exhaust system, a fresh air heater exterior to the chamber, in accordance with a preferred embodiment of the invention.
Figure 2:
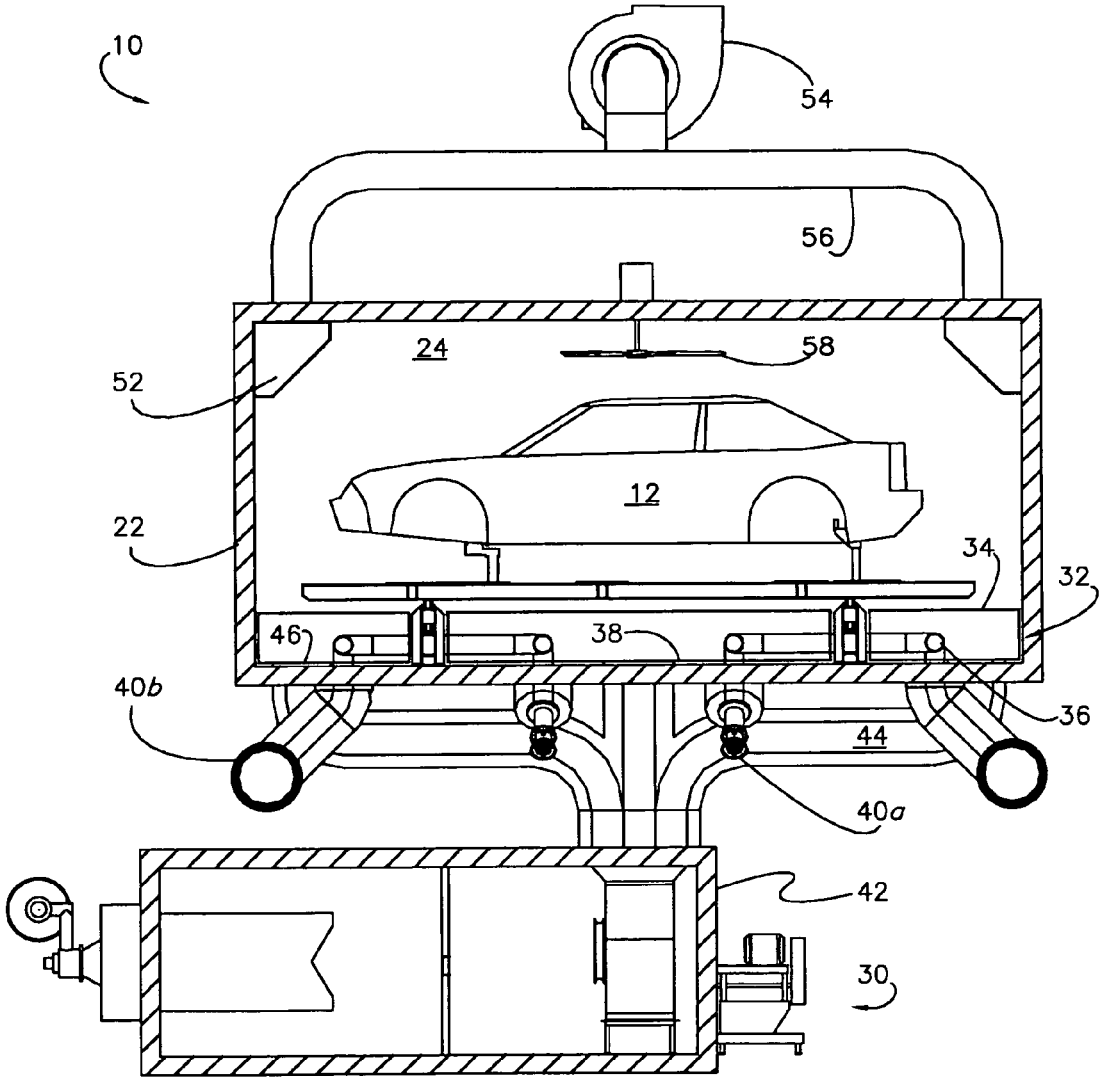
FIG. 2 is a cross-sectional elevation view of the workpiece and oven shown in FIG. 1.
Figure 3:
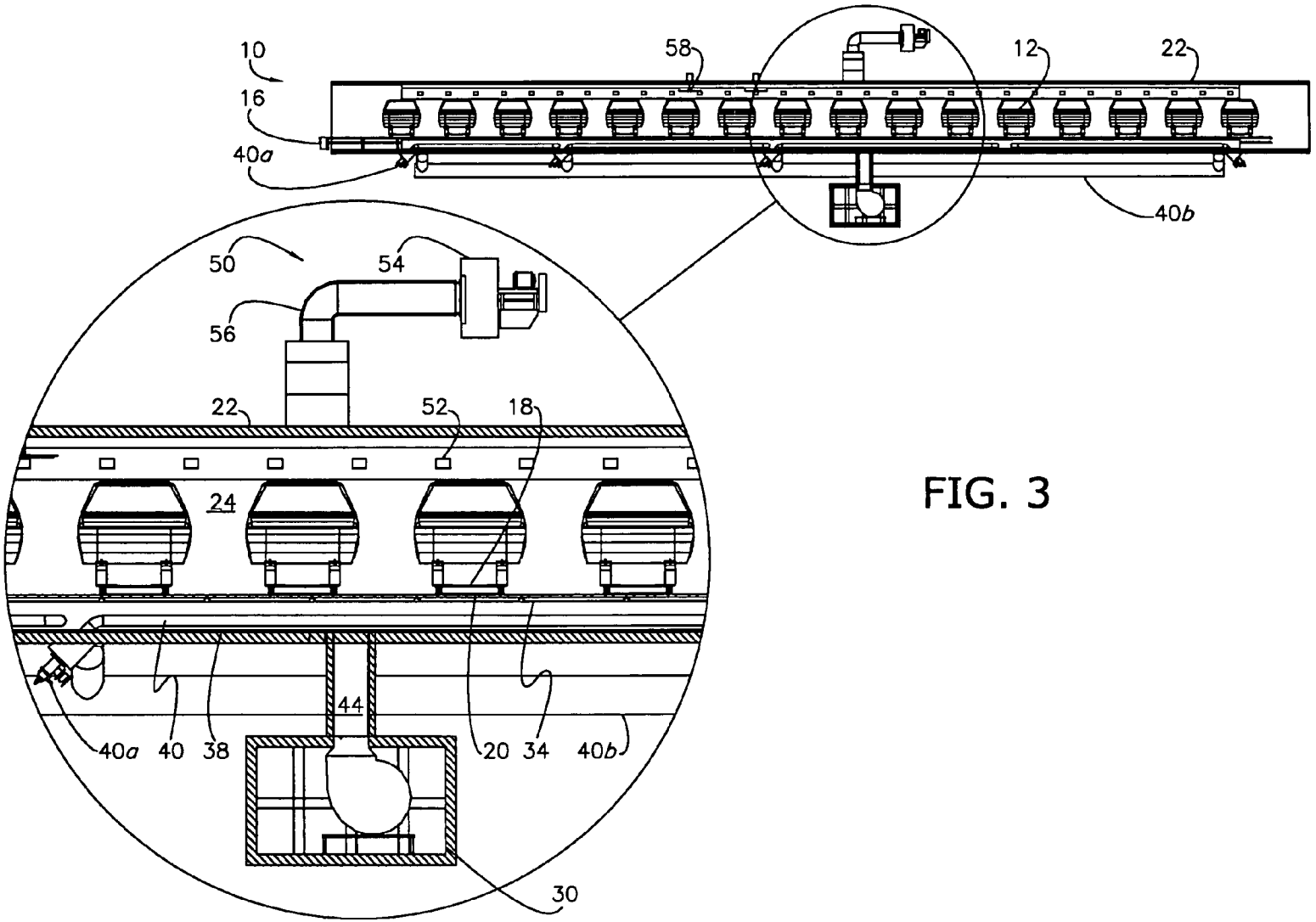
FIG. 3 is a longitudinal side elevation view of the oven shown in FIG. 1 treating a plurality of workpieces.

Referring collectively to FIGS. 1-5, the present invention concerns a transverse oven 10 adapted for uniformly baking to a target temperature at least one, and more preferably a plurality of transversely oriented workpieces 12 (FIG. 3). The invention is described and illustrated with respect to automotive workpieces, such as the vehicular bodies shown in the illustrated embodiment; however, it is certainly within the ambit of the invention to utilize the benefits and features of the oven 10 to bake other objects and in other manufacturing applications.

The inventive oven 10 is preferably used in conjunction with a conveyance system 14 suitable for conveying the workpieces 12 so that they enter, pass through, and exit the oven 10 at a controlled rate (FIGS. 1-4). As such, the preferred conveyance system 14 is in operative communication with the oven 10 and more preferably, through a controller 16 (FIG. 3). For example, as best shown in FIG. 1, a conventional skid conveyance system 14 including at least one (lift) skid 18, tracks 20, and a drive mechanism (not shown), may be utilized. In this configuration, the workpieces 12 may be placed on the skid 18 in the afore-mentioned transverse orientation, wherein the term "transverse orientation" shall mean that an angle not less than twenty, more preferably, not less than forty five, and most preferably, generally equal to ninety degrees is defined by the longitudinal axes of the oven 10 and each workpiece 12 (FIGS. 1-3) upon entry. More preferably, the conveyance system 14 is operable to rotate each workpiece 12 from a longitudinal and to the transverse orientation just before it enters, and back to the longitudinal orientation after it exits the oven 10, so as to facilitate travel from the previous and to the next workstation (FIG. 5).

Figure 5:
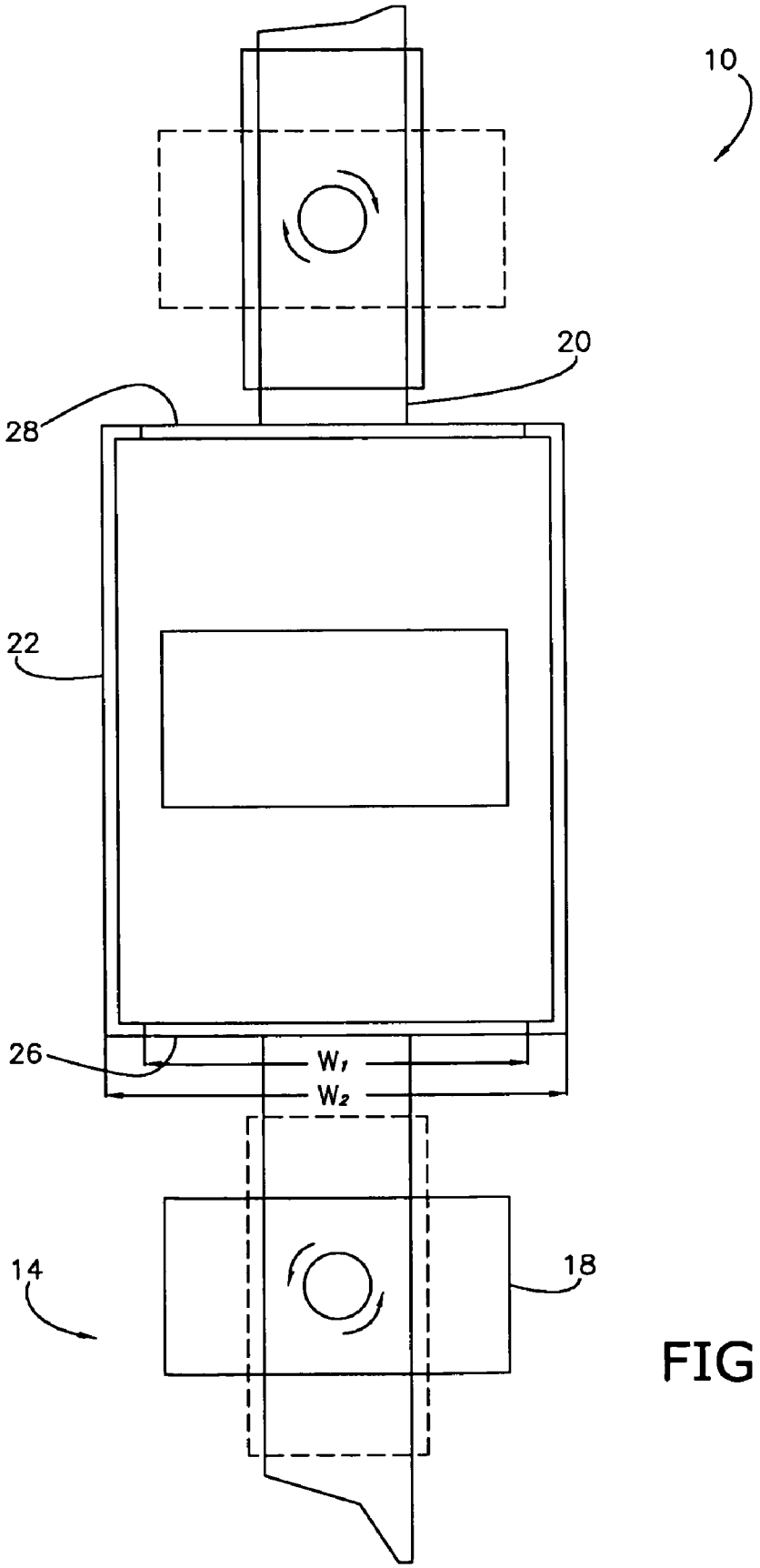
FIG. 5 is a plan view of an oven and a workpiece, particularly illustrating the rotation of the workpiece before it enters and when it exits the oven, in accordance with a preferred embodiment of the invention.

The oven 10 includes a chamber 22 defining a preferably enclosable interior space 24, an entrance 26, a longitudinal length, and an exit 28 (FIGS. 2 and 5). Whereas each workpiece 12 presents a length and width, both the entrance 26 and exit 28 present openings having a width greater than the workpiece length, so that the workpiece 12 can enter, pass through, and exit the chamber 22 in a transverse position, facilely. Thus, another aspect of the invention concerns the ratio defined by the entrance/exit widths, $W_1$, versus the chamber width, $W_2$ (FIG. 5). It is appreciated that the generally vertical relationship between the heating sources and workpiece 12, enables the width of the chamber 22 to remain comparable to prior art conventional longitudinal ovens that feature perimeter heating elements. This ratio for the inventive transverse oven is therefore preferably greater than 80%, and more preferably greater than 95%. It is appreciated that the entrance, exit and chamber widths need only be large enough to accommodate the workpiece length and may generally be congruent, so as to maximize the treatable workpiece length by the oven 10. Finally, the chamber 22 preferably presents a longitudinal length greater than the width of the workpiece 12, so that the entrance 26 and exit 28 may be closed, for example, by a sliding door (not shown), once at least one workpiece 12 enters the interior space 24. More preferably, and as shown in FIG. 3, the longitudinal length of the chamber enables the concurrent heating of a plurality of workpieces 12 and enables the establishment of varying treatment zones, as described below.

The inventive oven 10 includes dual convection and radiant heat sources 30,32 that are each thermally coupled to the interior space of the chamber 22 (FIG. 2). The sources 30,32 are combined and cooperatively configured to heat the workpiece 12 to a target temperature range, as determinable by at least one feedback sensory device operable to detect the temperature within the space 24. As further described below, the target temperature range depends upon at least one condition of the application and/or workpiece 12, such as for example, the material composition and thickness of the workpiece 12, or the type of application (e.g., Electric coat (E-coat), Prime coat, Top coat, adhesive, etc.) to be cured. Where a condition, such as material thickness, presents differing workpiece values, an aggregate is determined. For example, it is appreciated that the rocker area of a vehicle may be constructed with multiple layers of metal having a range in thickness of 1 mm to 2 mm, while the fender and door skins are formed by a single layer of metal not greater than 1 mm.

In a preferred embodiment, the chamber 22 includes a false floor 34 above which the workpiece 12 travels as it passes through (FIGS. 1-3). The floor 34 is preferably flush with the exterior chamber floor so that the track 20 of the conveyance system 14 is able to continue through the chamber 22. The load of the workpiece 12 in the chamber 22 is supported by the conveyance system 14 shown in FIGS. 1 and 2. Alternatively, the floor 34 may be elevated relative to the outside chamber floor, and longitudinally segmented so as to allow the skid 18, tracks 20, or otherwise transportation structure to pass therethrough.

In another aspect of the invention, the false floor 34 functions to provide a uniform radiant heat source 32 and as such, is preferably formed of a "high emissivity" or thermally conductive material, such as uncoated steel, coated steel, steel alloys, and the like. Moreover, composite structures of plural layers of like or dissimilar materials may also be used. The remaining structures of the chamber 22 are also formed of material able to withstand the repeated application of anticipated temperatures (e.g., 350° F. for E-coat, and 250° F. for Prime and Top coat, etc.).

To heat the floor 34, at least one element 36 operable to generate radiant heat energy is positioned beneath, and proximate to the bottom surface of the floor 34 (FIGS. 1 and 2). In the illustrated embodiment, the elements 36 are positioned not greater than six inches from the surface. The rate of heat transfer through the floor 34 compared to the rate of radiation therefrom is such that radiant heat energy is uniformly emitted throughout the lateral profile of the floor 34 and into the space 24 (FIGS. 1-2). It is appreciated that by presenting a heat source beneath the workpiece 12, better treatment is afforded the lateral centerline of the chamber 22 in comparison to prior art perimeter heating ovens.

Figure 4:
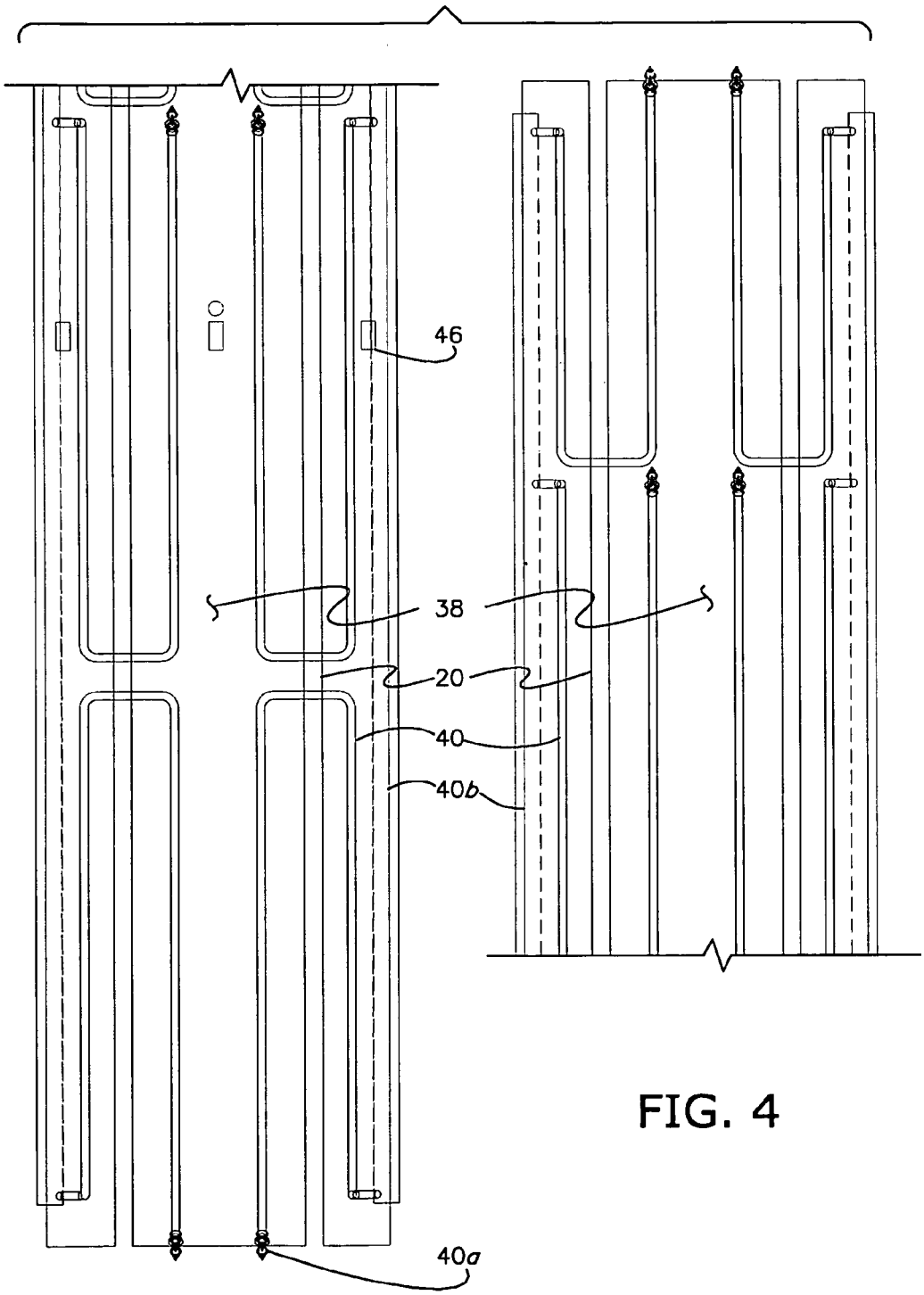
FIG. 4 is a planar view of a radiant heating tube configuration (in bifurcated layout), in accordance with a preferred embodiment of the invention.

In a preferred embodiment, the oven 10 further includes at least one and more preferably a plurality of low emissivity reflectors 38 opposite the floor 34 and beneath the elements 36 (FIGS. 2 and 4). The reflectors 38 are configured and operable to deflect radiant heat energy originally emitted by the elements 36 away from the floor 34, back towards the floor 34. The low emissivity of the reflectors 38 enables most of the wayward radiant energy to be redirected towards the floor 34. Each reflector 38 may generally consist of a non-polished surface of suitable composition to withstand the anticipatory temperatures and conditions beneath the floor 34.

In the illustrated embodiments, the elements 36 present congruently spaced radiant tubes 40 and a gas fired burner **40*a* (FIGS. 1-4). In the preferred embodiment shown in FIGS. 1-4, a plurality of individually controllable burners 40*a* are presented, wherein each radiant tube burner 40*a* is operable to produce a flame within a tube 40, so as to heat the tube 40 and air circulated therein to approximately 540°. In this embodiment, where the floor 34 is preferably spaced 18 inches from the base of the chamber 22, each of the tubes 40 preferably presents an outside diameter of 6 inches and define a central axis spaced from the base of the chamber 9 inches, so as to be equidistance from the base and floor 34. Each radiant tube burner 40*a* communicates with the controller 16, which introduces a fuel mixture into the tube 40 (FIG. 1-4**).

As shown in FIG. 4, a series of "U" shaped tubes 40 may be utilized in a back-to-back longitudinal layout. Each tube 40 is preferably connected to one of two collector ducts **40*b* running longitudinally along the outside of the lower corners of the chamber 22 exterior to the space 24 (FIG. 2). The ducts 40*b* are configured to collect and discard the exhaust from the tubes 40. More preferably, each duct 40***b* receives and the exhaust is mixed with dilution air, so as to minimize the potential hazardous effect of the exhaust.

Consistent with the "U"-shaped configuration shown in FIG. 4 (except for the bends), each tube 40 preferably defines a longitudinal axis that is oriented generally parallel to the longitudinal axis of the oven 10.

Also shown in the illustrated embodiment, the convection heat energy source 30 preferably includes a fresh air heater 42 fluidly coupled to an ambient space and the interior space 24 by at least one conduit 44 and more preferably, a plurality of conduits 44 (FIGS. 1 and 2), and an outlet 46. The heater 42 is configured to cause air to flow from the ambient space, through its core, where it is heated, and into the interior space 24. More preferably, the outlet 46 is defined by the chamber 22 beneath the false floor 34 so that the air is further heated by the radiant elements 34. For example, and as shown in FIGS. 2 and 5, the outlet(s) 46 may be located at the base of the chamber 22, and below the elements 36 and reflectors 38. The floor 34 then defines at least one air intake opening 48 (FIG. 1) that allows the twice-heated air to flow into the space 24. More preferably, the air intake openings 48 are strategically positioned relative to the workpiece 12 so as to ensure proper heating. For example, a plurality of air intake openings 48 may be defined to introduce convection heating air at the rocker areas of the vehicle 12. The openings 48 may present a plurality of smaller (e.g., 1 inch) diameter openings (FIG. 1). Alternatively, it is appreciated that the fresh heated air may be introduced above the floor 34 via flexible ducts (not shown).

The floor 34 presents a generally integral structure (FIG. 1), except for segmentation required by the conveyance system 14. Alternatively, however, the floor 34 may be an assembly of detached or removably interconnected panels. In this configuration, the panels may sit upon a floor truss (not shown), and are reconfigurable such that the intake openings 48 are relocatable to provide flexibility in treating a plurality of differing workpiece configurations, or to change the air movement pattern.

The preferred oven 10 further includes an exhaust system 50 fluidly coupled to and configured to cause heated air to flow from the interior space 24 and to an abatement system (not shown) in order to collect evaporated paint solvents and/or particulate matter released during the curing process. The exhaust system 50 includes at least one, and more preferably a plurality of outlet registers 52 preferably located at the upper corners of the space 24 (FIGS. 1-3). An exhaust fan 54 is fluidly coupled to and configured to produce negative air pressure at each outlet register 52. At least one exhaust conduit 56 may be provided to interconnect a group of registers 52 to the exhaust fan 54, so as to deliver negative air pressure at each register 52. The fan 54 is preferably centrally located atop the chamber 22 so as to minimize the distance to and equalize the air pressure at each register 52. As shown, the conduit 56 may sit atop, or more preferably, be elevated above the chamber 22 (FIGS. 1-3).

In a preferred embodiment, the oven 10 yet further includes at least one, and more preferably a plurality of ceiling fans 58 located and configured to agitate the air within the space 24, so as to accelerate heating (FIGS. 1-3, and 5). As it is appreciated that hot air rises with natural convection, the ceiling fans 58 are configured to cause lighter heated air to flow from the ceiling of the chamber 22 and towards the workpiece 12. This promotes the convection heating process and further equalizes the temperature inside the space 24. The ceiling fans 58 are preferably sized as a unit to recirculate the air volume within the space or zone more than 6 times per minute. To provide greater flexibility each fan 58 is preferably controlled separately (e.g., on/off, speed, duration, etc.), such that a range of agitation and air movement patterns can be achieved.

Finally, it is appreciated that the controller 16 is communicatively coupled to the sources 30,32 (including the fans 58). The preferred controller 16 is programmably configured to actuate the sources 30,32 for a predetermined period, or where sensory input is provided, until the occurrence of an event (e.g., a thermometer reading within the target temperature range). The controller 16 preferably provides a user interface so that information relating to workpiece condition and/or application may be entered by the operator and considered, as previously described. It is appreciated that suitable software, processing, storage and communicative capabilities of the controller 16 are readily determinable by one of ordinary skill in the art without undue experimentation, and as such will not be further described herein.

An exemplary method of baking a workpiece 12 utilizing the inventive oven 10 is therefore presented, and begins by rotating the workpiece 12 to a transverse orientation, just before entering the chamber 22. During an initial "Bring-up" period, the radiant floor 34, fresh air heater 42 and/or at least one ceiling fan 58 are actuated depending upon the application. For example, for proper curing of an E-coat layer, all of the components are preferably actuated; and for a Prime or Top coat, only the heater 42 and floor 34 are preferably actuated (so as to prevent anomalies caused by agitation in the finished product), during a 10-minute Bring-up period. In this example, for each of these applications, all of the components are preferably actuated for an additional 3 to 5-minute "Equalize" period, immediately following the Bring-up period; and finally, all of the components are again preferably actuated for a 20-minute "Hold" period, immediately following the Equalize period. The Bring-up, Equalize and Hold periods are determined after predetermining the target temperature range based on at least one condition of the workpiece. The uniformly baked workpiece 12 is then exited from the oven in the transverse orientation, and preferably rotated back to the longitudinal orientation to resume travel.

More preferably, the oven 10 defines multiple zones for concurrently treating a plurality workpieces 12. For example, the preferred oven 10 may be longitudinally configured to define Bring-up, Equalize, and Hold zones sequentially. In FIG. 3, a Prime and/or Top coat curing configuration is illustrated, wherein ceiling fans 58 are encountered after traversing one-third of the oven length. At this position, turbulation is provided towards the end of the Bring-up period and gradually increases towards peak turbulation during the Equalize period. The effect of the ceiling fans dissipates, as the workpiece continues to traverse the oven 10. The sources 30,32, including the fans 58 continuously function, while a particular workpiece 12 travels first through the Bring-up zone, then through the Equalize zone, and finally through the Hold zone. Alternatively, the zones may be separately actuated (e.g., only one set of burners 40*a* may be fired at a time) as the workpiece 12 travels, so as to track the workpiece 12.

The preferred forms of the invention described above are to be used as illustration only, and should not be utilized in a limiting sense in interpreting the scope of the general inventive concept. Obvious modifications to the exemplary embodiments and methods of operation, as set forth herein, could be readily made by those skilled in the art without departing from the spirit of the present invention. The inventors hereby state their intent to rely on the Doctrine of Equivalents to determine and assess the reasonably fair scope of the present invention as pertains to any system or method not materially departing from but outside the literal scope of the invention as set forth in the following claims.

What is claimed is:

1. A transverse oven adapted for baking a workpiece, wherein the workpiece presents a first longitudinal axis, length and width, said oven comprising:

an enclosable chamber defining an interior space, an entrance, an exit, and a second longitudinal axis, wherein said chamber, entrance and exit are cooperatively configured such that the workpiece is able to enter, pass through, and exit the space, when the first and second axes define an angle not less than twenty degrees as the workpiece enters, passes through and exits the space;

a plurality of radiant and convection heat sources thermally coupled to the space and cooperatively configured to heat the entire workpiece to a predetermined temperature range, when the workpiece is in the space; and a fresh air heater fluidly coupled to the interior space and an ambient space, configured to cause air to flow from the ambient space, therethrough, and to the interior space, and further configured to heat the air as it flows therethrough.

2. The oven as claimed in claim 1, wherein the chamber includes a high emissivity false floor above which the workpiece travels as it passes through, and the sources include radiant elements positioned beneath the floor and operable to generate radiant heat energy that transmits through the floor and into the space.

3. The oven as claimed in claim 2, wherein the floor is formed of high emmissivity steel.

4. The oven as claimed in claim 2, wherein the sources include congruently spaced radiant tubes and a burner configured to heat a fluid that circulates within the tubes.

5. The oven as claimed in claim 2, wherein the sources include congruently spaced radiant tubes and a burner configured to produce a flame within the tubes.

6. The oven as claimed in claim 2, further comprising:

a plurality of low emissivity reflectors located beneath the elements and configured to reflect a portion of the energy towards the floor.

7. The oven as claimed in claim 1, wherein the chamber includes a high emissivity false floor above which the workpiece travels as it passes through, the floor defines at least one air intake opening, the sources include radiant elements congruently spaced beneath the floor and operable to generate radiant heat energy that transmits through the floor and into the space, and the air heater is connected to the chamber beneath the floor, such that the air is caused to flow near and be further heated by the elements, then through the opening, and into the interior space.

8. The oven as claimed in claim 7, wherein the floor is an assembly of detachable panels, and reconfigurable so as to relocate said at least one opening.

9. The oven as claimed in claim 1, further comprising:

an exhaust fluidly coupled to the interior space.

10. The oven as claimed in claim 1, further comprising:

at least one convection air ceiling fan located and configured to agitate air within the space.

11. The oven as claimed in claim 1, further comprising:

a controller configured to control the radiant and convection heat sources, wherein the radiant source includes a floor and the convection source includes the fresh air heater, and the controller is configured to control the temperatures of the floor and heater.

12. The oven as claimed in claim 11, further comprising:

a controller configured to receive input of at least one workpiece condition, communicatively coupled to the sources and programmably configured to cause the sources to heat the workpiece, based the workpiece condition, wherein said at least one condition is the workpiece material composition, thickness, and coating to be applied.

13. A manufacturing oven adapted for baking a workpiece, wherein the workpiece presents a first longitudinal axis, length and width, said oven comprising:

an enclosable chamber defining an interior space, entrance and outlet openings, and a second longitudinal axis, wherein said chamber, entrance and outlet are cooperatively configured such that the workpiece is able to enter, pass through, and exit the space when the first and second axes define an angle between zero and ninety degrees; the chamber includes a high emissivity false floor above which the workpiece travels as it passes;

a plurality of radiant and convection heat sources thermally coupled to the interior space and cooperatively configured to heat the entire workpiece to a target temperature range, when the workpiece is in the space, wherein the sources include radiant elements positioned beneath the floor and operable to generate radiant heat energy that transmits through the floor and into the interior space;

a fresh air heater fluidly coupled to the interior space and an ambient space, configured to cause air to flow from the ambient space, through the heater, and to the interior space, and further configured to heat the air as it flows through the heater;

a ceiling fan housed within the chamber and configured to agitate the air therein and direct heated air towards the workpiece; and a controller communicatively coupled to the heat sources and fan, operable to receive input relating to at least one workpiece condition, and programmably configured to cause the sources and fan to heat the workpiece based said at least one workpiece condition.

14. A method of baking a workpiece defining a first longitudinal axis, in an oven defining a second longitudinal axis, said method comprising the steps of:

a. rotating the workpiece to a transverse orientation, wherein the first and second longitudinal axes form a minimum angle, and entering the workpiece into the oven in the transverse orientation;

b. treating the workpiece with convection heating during a period, so as to cause the workpiece to reach a target temperature range;

c. treating the workpiece with radiant heating during the period, so as to cause the workpiece to reach a target temperature range; and d. exiting the workpiece from the oven in the transverse orientation, after the period.

15. The method as claimed in claim 14, wherein step b) further includes the steps of predetermining the target temperature range based on at least one condition of the workpiece.

16. The method as claimed in claim 14, wherein step b) further includes the steps of causing heated fresh air to flow through an opening and towards the workpiece, and the opening is positioned relative to the workpiece.

17. The method as claimed in claim 16, wherein step b) further includes the steps of agitating the air with a ceiling fan, and step c) further includes the steps of uniformly heating the workpiece by emitting radiant heat energy through a high emissivity floor.

18. The method as claimed in claim 14, wherein steps b) and c) further include the steps of actuating at least one of a radiant heat source, convection heat source and ceiling fan for an initial Bring-up period, subsequent Equalize period, and final Hold period, based on at least one condition of the workpiece.

19. The method as claimed in claim 18, wherein the chamber is longitudinally configured to treat a plurality of workpieces and simultaneously define separate Bring-up, Equalize and Hold zones, and each workpiece traverses the zones sequentially.

20. A transverse oven adapted for baking a workpiece, wherein the workpiece presents a first longitudinal axis, length and width, said oven comprising:

an enclosable chamber defining an interior space, an entrance, an exit, and a second longitudinal axis, wherein said chamber, entrance and exit are cooperatively configured such that the workpiece is able to enter, pass through, and exit the space, when the first and second axes define an angle not less than twenty degrees as the workpiece enters, passes through and exits the space; and a plurality of radiant and convection heat sources thermally coupled to the space and cooperatively configured to heat the entire workpiece to a predetermined temperature range, when the workpiece is in the space; and wherein the chamber includes a high emissivity false floor above which the workpiece travels as it passes through, and the sources include radiant elements positioned beneath the floor and operable to generate radiant heat energy that transmits through the floor and into the space, and a plurality of low emissivity reflectors located beneath the elements and configured to reflect a portion of the energy towards the floor.

21. A transverse oven adapted for baking a workpiece, wherein the workpiece presents a first longitudinal axis, length and width, said oven comprising:

an enclosable chamber defining an interior space, an entrance, an exit, and a second longitudinal axis, wherein said chamber, entrance and exit are cooperatively configured such that the workpiece is able to enter, pass through, and exit the space, when the first and second axes define an angle not less than twenty degrees as the workpiece enters, passes through and exits the space;

a plurality of radiant and convection heat sources thermally coupled to the space and cooperatively configured to heat the entire workpiece to a predetermined temperature range, when the workpiece is in the space; and a controller configured to control the radiant and convection heat sources, wherein the radiant source includes a floor and the convection source includes a fresh air heater, and the controller is configured to control the temperatures of the floor and heater.

22. The oven as claimed in claim 21, further comprising:

a controller configured to receive input of at least one workpiece condition, communicatively coupled to the sources and programmably configured to cause the sources to heat the workpiece, based the workpiece condition, wherein said at least one condition is the workpiece material composition, thickness, and coating to be applied.

* * * * *